US011149751B2

(12) United States Patent
Krishnababu

(10) Patent No.: US 11,149,751 B2
(45) Date of Patent: Oct. 19, 2021

(54) TECHNIQUE FOR CONTROLLING ROTATING STALL IN COMPRESSOR FOR A GAS TURBINE ENGINE

(71) Applicant: Siemens Energy Global GmbH & Co. KG, Munich (DE)

(72) Inventor: Senthil Krishnababu, Lincoln (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 190 days.

(21) Appl. No.: 16/330,848

(22) PCT Filed: Sep. 19, 2017

(86) PCT No.: PCT/EP2017/073669
§ 371 (c)(1),
(2) Date: Mar. 6, 2019

(87) PCT Pub. No.: WO2018/054916
PCT Pub. Date: Mar. 29, 2018

(65) Prior Publication Data

US 2019/0203737 A1 Jul. 4, 2019

(30) Foreign Application Priority Data

Sep. 20, 2016 (EP) ..... 16189719

(51) Int. Cl.
*F04D 29/68* (2006.01)
*F04D 27/02* (2006.01)
*F04D 29/54* (2006.01)

(52) U.S. Cl.
CPC ..... *F04D 29/684* (2013.01); *F04D 27/0238* (2013.01); *F04D 29/542* (2013.01);
(Continued)

(58) Field of Classification Search
CPC ... F01D 5/14; F01D 5/18; F01D 5/148; F01D 9/02; F01D 9/041; F04D 27/0238;
(Continued)

(56) References Cited

U.S. PATENT DOCUMENTS 4,196,472 A * 4/1980 Ludwig ..... F02C 9/18 340/966
5,141,391 A * 8/1992 Acton ..... F01D 17/02 415/119

(Continued)

FOREIGN PATENT DOCUMENTS

DE 976186 C 4/1963
EP 1536147 A2 6/2005

(Continued)

OTHER PUBLICATIONS

International search report and written opinion dated Jan. 5, 12018 for corresponding PCT/EP2017/073669.

(Continued)

*Primary Examiner* — Courtney D Heinle
*Assistant Examiner* — Sang K Kim

(57) ABSTRACT

A technique for controlling a rotating stall in a compressor of a gas turbine engine. In the technique a flow injection is introduced into an axial air flow path of the compressor via a flow-injection opening located at a pressure side of a guide vane in the compressor and directed towards a leading edge of a compressor rotor blade located adjacently downstream of the guide vane. The flow injection is introduced when the rotating stall is detected and/or when the compressor is being operated at a speed lower than full load speed. The flow injection reduces an angle of incidence of compressor air on the leading edge of the downstream rotor blade and hence the rotor sees a more favorable velocity. The favorable velocity results into an increase in the operating range of the (Continued)

rotor and hence of the compressor by mitigating and/or reducing the rotating stalls.

16 Claims, 4 Drawing Sheets

(52) U.S. Cl.
CPC .. *F05D 2240/122* (2013.01); *F05D 2240/123* (2013.01); *F05D 2270/101* (2013.01)

(58) Field of Classification Search
CPC ..... F04D 29/542; F04D 29/684; F05D 2240/122; F05D 2240/123; F05D 2270/121
See application file for complete search history.

(56) References Cited

U.S. PATENT DOCUMENTS 5,275,528 A * 1/1994 Freeman ..... F04D 27/0207 415/1
5,340,271 A 8/1994 Freeman et al.
6,125,626 A * 10/2000 El-Aini ..... F01D 5/10 60/226.1
8,834,116 B2 * 9/2014 Guemmer ..... F04D 29/681 416/93 R
2005/0141990 A1 6/2005 Guemmer
2009/0003989 A1 1/2009 Guemmer
2010/0098527 A1 4/2010 Guemmer
2011/0027065 A1 * 2/2011 Bryan ..... F04D 29/563 415/1

FOREIGN PATENT DOCUMENTS

FR 1263010 A 6/1961
JP 2012207623 A 10/2012
WO 9203661 A1 3/1992

OTHER PUBLICATIONS

Yinghong, Li et al:; Test Techniques and Methods for Aviation Turbofan Engine, Shanghai Jiao Tong University Press, pp. 122-123 and Figs 3-10, Dec. 2014.
Daxiang, Liu et al:; Stability Design and Evaluation Techniques of Aviation Gas Turbine Engine, Aviation Industry Press, pp. 287-289 and Figs 9-91 and 9-93, Jun. 2004.

* cited by examiner

TECHNIQUE FOR CONTROLLING ROTATING STALL IN COMPRESSOR FOR A GAS TURBINE ENGINE

CROSS REFERENCE TO RELATED APPLICATIONS

This application is the US National Stage of International Application No. PCT/EP2017/073669 filed Sep. 19, 2017, and claims the benefit thereof. The International Application claims the benefit of European Application No. EP16189719 filed Sep. 20, 2016. All of the applications are incorporated by reference herein in their entirety.

FIELD OF INVENTION

The present invention relates to techniques of controlling rotating stall faults in a compressor, and more particularly to systems and methods for controlling rotating stalls in a compressor for a gas turbine engine.

BACKGROUND OF INVENTION

In a compressor operating under normal, i.e. stable flow conditions, the flow through the compressor is essentially uniform around the annulus, i.e. it is axis-symmetric, and the annulus-averaged flow rate is steady. Generally, if the compressor is operated too close to the peak pressure rise on the compressor pressure rise versus mass flow, constant speed performance map, disturbances acting on the compressor may cause it to encounter a region on the performance map in which fluid dynamic instabilities, known as rotating stall and/or surge, develop. This region is bounded on the compressor performance map by the surge/stall line. The instabilities degrade the performance of the compressor and may lead to permanent damage, and are thus to be avoided.

Rotating stall can be understood as a phenomenon that results in a localized region of reduced or reversed flow through the compressor which rotates around the annulus of the flow path. The region is termed "stall cell" and typically extends axially through the compressor. Rotating stall results in reduced output (as measured in annulus-averaged pressure rise and mass flow) from the compressor. In addition, as the stall cell rotates around the annulus it loads and unloads the compressor blades and may induce fatigue failure. Surge is a phenomena defined by oscillations in the annulus-averaged flow through the compressor. Under severe surge conditions, reversal of the flow through the compressor may occur. Both types of instabilities, i.e. the rotating stalls and/or surges which may result from the rotating stalls, need to be avoided.

In practical applications, the closer the operating point is to the peak pressure rise, the less the compression system can tolerate a given disturbance level without entering rotating stall and/or surge. Triggering rotating stall results in a sudden jump (within 1-3 rotor revolutions) from a state of high pressure rise, efficient, axis-symmetric operation to a reduced pressure rise, inefficient, non-axis-symmetric operation. Returning the compressor to axis-symmetric operation (i.e., eliminating the rotating stall region) requires lowering the operating line on the compressor performance map to a point well below the point at which the stall occurred. In practical applications, the compressor may have to be shut down and restarted to eliminate (or recover from) the stall. This is referred to as stall hysteresis. Triggering surge results in a similar degradation of performance and operability.

As a result of the potential instabilities, i.e. rotating stalls and surges, compressors are typically operated with a "stall margin". Stall margin is a measure of the ratio between peak pressure rise, i.e. pressure rise at stall, and the pressure ratio on the operating line of the compressor for the current flow rate. Generally, the greater the stall margin is, the larger is the disturbance that the compressor can tolerate before entering stall and/or surge. Thus, the design objective has been to incorporate enough stall margin to avoid operating in a condition in which an expected disturbance is likely to trigger stall and/or surge. In gas turbine engines, stall margins of fifteen to thirty percent are common. Since operating the compressor at less than peak pressure rise carries with it a reduction in operating efficiency and performance, there has been a trade-off between stall margin and performance. Furthermore, rotating stalls besides significantly affecting the stall/surge margin of the compressor also give rise to blade dynamic issues. The rotating stall fault, or the rotating stall, is detected in compressors, such as compressors for gas turbines, with the help of various detection techniques for example by using pressure sensors and/or vibration recorders that are positioned at different positions along the compressor stages. The quality and the selectivity of the detection depend on the positioning and the number of sensors and/or recorders.

Even in compressors designed with substantial stall margins, and therefore having reduced operating efficiency and performance, rotating stalls still occur. After detection of a rotating stall, generally a measure is required to control, i.e. to alleviate or eliminate, the rotating stall. In cases where a compressor is equipped with an effective control system that can control rotating stalls, i.e. the control systems that can completely or partially obviate development of rotating stalls and/or that can alleviate or eliminate developing or developed rotating stalls, the stall margins can be kept low during designing of the compressor and thus higher operating efficiency and performance for the compressor is achievable. The stall margins can be kept low during designing of the compressor because higher stall margins are achieved by function of the control techniques.

One such control technique, involves variable guide vanes (VGVs) which are turned to direct the air flow to favorable angles for the downstream rotor blades and thus resulting into controlling of the rotating stall. This, however, does not always fully avoid the development of rotating stall and/or the removal of an already developed rotating stall. Furthermore, the maximum extents to which the VGVs can be turned are limited by mechanical restrictions dictated by the need to avoid undesirably large tip and penny gaps.

SUMMARY OF INVENTION

Therefore an object of the present invention is to provide a technique, particularly a method and a system, for controlling rotating stalls in compressors. The desired technique, besides being advantageous on account of completely or partially obviating development of rotating stalls and/or alleviating or eliminating developing or developed rotating stalls, allows for compressor designs with high operating efficiency and performance.

The above objects are achieved by a method for controlling a rotating stall in a compressor for a gas turbine engine, and a system for controlling a rotating stall in a compressor for a gas turbine engine of the present technique. Advantageous embodiments of the present technique are provided in dependent claims.

In an aspect of the present technique, a method for controlling a rotating stall in a compressor of a gas turbine engine is presented. In the method, a flow injection is introduced into an axial air flow path of the compressor via a flow-injection opening. The flow-injection opening is located at a pressure side of at least one guide vane of a plurality of guide vanes that together form a guide vane stage in the compressor. The flow injection is directed towards a leading edge of a compressor rotor blade located adjacently downstream of the guide vane having the flow-injection opening. The flow injection reduces an angle of incidence of compressor air on the leading edge of the downstream compressor rotor blade and hence the compressor rotor blade, and therefore the rotor formed from the compressor rotor blade, is subjected to a more favorable velocity of the compressor air in the axial flow of the compressor. The favorable velocity results into an increase in the operating range of the rotor and hence of the compressor by mitigating and/or reducing the rotating stalls. Thus, stall/surge margin, i.e. the stall margin, is extended through flow injection, especially at low speeds. It may be noted that each guide vane of the plurality may have a flow-injection opening located at a pressure side of the guide vane, the plurality of guide vanes together form the guide vane stage in the compressor.

Furthermore, when the present technique is used in combination with known techniques that involve variable guide vanes (VGVs) that are turned to direct the air flow to favorable angles for the downstream compressor rotor blades in order to control the rotating stalls, the maximum extent of VGV stagger angle variations i.e. extent to which VGVs are designed to be rotated could be reduced. This reduces the amount of tip grinding for the VGVs and hence the tip gaps thus increasing the performance at other speeds particularly the design speed. Moreover, avoidance/reduction in the strength of rotating stall reduces the self-induced forcing in the downstream rotor blades thus reducing blade dynamics issues.

Furthermore, when the present technique is used in combination with known techniques that involve bleed systems that remove pressurized air from the compressor in order to control the rotating stalls, the amount of compressed air removed could be reduced. Moreover, avoidance/reduction in the strength of rotating stall reduces the self-induced forcing in the downstream rotor blades thus reducing blade dynamics issues.

The present technique may be used in combination with a number of known techniques such as variable stator vanes and bleed systems.

In an embodiment of the method, a condition for introducing flow injection in the compressor is determined during operation of the gas turbine engine. The flow injection in the compressor is introduced when the condition for introducing flow injection in the compressor is determined i.e. when the condition is present. The condition for introducing flow injection in the compressor during operation of the gas turbine engine is detection of the rotating stall in the compressor. In a related embodiment, the method includes detecting the rotating stall in the compressor. As a result, the method of the present technique is beneficially applied to conditions where rotating stall has already developed or is developing, and thus by use of the method of the present technique the rotating stall is controlled, i.e. alleviation or elimination of developing or developed rotating stalls. Detection of rotating stall may be made via pressure sensors mounted within the compressor. Alternatively or as well, rotating stall may be detected by monitoring compressor (or blade) vibrations via an optical or digital probe in view of the blades. Where the actual pressure and/or vibration reaches a critical or pre-determined threshold flow injection is introduced in the compressor. An engine control unit may be programmed to monitor the pressure sensors or vibration probe and when the threshold is met, activate a valve in an air feed to the at least one guide vane to allow air to be injected into the compressor. The valve may be variably operated to inject a variable amount of air depending on the extent of rotating stall and the pressure or vibration incurred.

In another embodiment of the method, the flow injection is introduced in the compressor when the compressor is being operated at a speed lower than full load speed for the compressor or the design speed of the compressor i.e. the speed for which the compressor has been designed to operate normally. Advantageously, the flow injection is introduced in the compressor when the compressor is being operated at a speed lower that is between 40% and 75% of the full load speed of the compressor or the design speed of the compressor. More advantageously, the flow injection is introduced in the compressor when the compressor is being operated at a speed lower that is between 50% and 70% of the full load speed of the compressor or the design speed of the compressor. The design speed may be 100% speed that the engine and therefore the compressor is rated to under normal operation. Furthermore, the critical or pre-determined threshold may be determined based on known vibration characteristics of the compressor which occur at known rotational speeds of the compressor. Thus flow injection may be implemented when any one or more of a pre-determined compressor speed, a vibration characteristic or a pressure threshold value or range of values is attained. As a result, the method of the present technique is beneficially applied to conditions where rotating stall may develop owing to low speed operations of the compressor, and thus by use of the method of the present technique the rotating stall is controlled, i.e. complete or partial obviation of development of rotating stalls.

In another embodiment of the method, the flow-injection opening is located between 5 percent and 30 percent of a chord length of the guide vane measured from a trailing edge of the guide vane. When located at this position the flow-injection emanating from the flow-injection opening easily impacts the leading edge of the compressor rotor blade located adjacently downstream of the guide vane.

In another embodiment of the method, the flow-injection opening is located between a base of the guide vane and 50 percent of a span of the guide vane measured from the base of the guide vane. The base of the guide vane is the part of the guide vane attached to the casing of the compressor. The guide vane may comprise a radially inner platform and may comprise a radially outer platform which each define a gas wash surface. The vane has a radial span from the radially inner platform to either the radially outer platform or the tip of the aerofoil (vane). The base of the guide vane may be the gas washed surface of the radially inner platform. The flow-injection opening may be located between 5% and 95% of the radial span of the vane measured from the base of the guide vane. When located at this position the flow-injection emanating from the flow-injection opening impacts the leading edge of the compressor rotor blade located adjacently downstream of the guide vane generating a more effective impact. An array of the flow-injection openings may be located between 5% and 95% of the radial span of the vane measured from the base of the guide vane and advantageously may located between a base of the guide vane and 50 percent of a span of the guide vane measured from the base of the guide vane.

In another embodiment of the method, the flow injection is introduced into the axial air flow path of the compressor at an angle between 30 degree and 60 degree with respect to an axis parallel to a rotational axis of the compressor. This provides an optimal range within which when the flow injection reaches the leading edge of the compressor rotor blade located downstream of the guide vane, the compressor rotor blade is subjected to an optimum velocity of the compressor air.

In another embodiment of the method, air of the compressor is channeled from a location downstream of a location of the guide vane having the flow-injection opening with respect to an axial flow direction of air in the compressor. Thus the pressure of the channeled air is greater that the pressure of the compressor air at the location of the guide vane having the flow-injection opening, and this facilitated introduction of the flow injection in the pressure conditions of the compressor.

In another embodiment of the method, at least one of the guide vanes of the plurality of guide vanes in the compressor is a stationary guide vane in the compressor and the flow-injection opening is located at a pressure side of the stationary guide vane; or at least one of the guide vanes of the plurality of guide vanes in the compressor is a variable guide vane in the compressor and the flow-injection opening is located at a pressure side of the variable guide vane; or at least one of the guide vanes of the plurality of guide vanes in the compressor is a stationary guide vane in the compressor having the flow-injection opening located at its pressure side and at least one of the guide vanes of the plurality of guide vanes in the compressor is a variable guide vane in the compressor having the flow-injection opening located at its pressure side. Thus the present method is beneficially implemented at different stages and/or through different stages, namely stationary guide vane stages and/or VGV stages of the compressor.

In another aspect of the present technique, a system for controlling a rotating stall in a compressor of a gas turbine engine is presented. The system includes a guide vane stage of the compressor and a controller. The guide vane stage of the compressor includes a plurality of guide vanes. At least one of the guide vanes of the plurality includes a flow-injection opening located at its pressure side. The flow-injection opening introduces a flow injection into an axial air flow path of the compressor such that the flow injection is directed towards a leading edge of a compressor blade located adjacently downstream of the guide vane having the flow-injection opening. The controller determines a condition for introducing flow injection in the compressor during operation of the gas turbine engine. The controller initiates introduction of the flow injection when the condition for introducing flow injection in the compressor is determined. Thus the system of the present technique controls rotating stalls in compressor of the gas turbine engine.

In an embodiment, the system includes a sensing arrangement. The sensing arrangement detects parameters indicative of rotating stall in the compressor. The controller receives the parameters so detected and based on the parameters determines the condition for introducing flow injection in the compressor.

In another embodiment, the system includes a flow controlling mechanism. The flow controlling mechanism regulates the flow injection emanating from the flow-injection opening of the guide vane. In this embodiment the controller controls the flow controlling mechanism effecting regulation of the flow injection.

In another embodiment of the system, the flow-injection opening is located between 5 percent and 30 percent of a chord length of the guide vane measured from a trailing edge of the guide vane. When located at this position the flow-injection emanating from the flow-injection opening easily impacts the leading edge of the compressor rotor blade located adjacently downstream of the guide vane.

In another embodiment of the system, the flow-injection opening is located between a base of the guide vane and 50 percent of a span of the guide vane measured from the base of the guide vane. When located at this position the flow-injection emanating from the flow-injection opening impacts the leading edge of the compressor rotor blade located adjacently downstream of the guide vane generating a more effective impact.

In another embodiment of the system, the flow-injection opening introduces the flow injection into the axial air flow path of the compressor at an angle between 30 degree and 60 degree with respect to an axis parallel to a rotational axis of the compressor. This provides an optimal range within which when the flow injection reaches the leading edge of the compressor rotor blade located downstream of the guide vane, the compressor rotor blade is subjected to an optimum velocity of the compressor air.

In another embodiment of the system, at least one of the guide vanes of the plurality of guide vanes in the compressor is a stationary guide vane in the compressor and the flow-injection opening is located at a pressure side of the stationary guide vane; or at least one of the guide vanes of the plurality of guide vanes in the compressor is a variable guide vane in the compressor and the flow-injection opening is located at a pressure side of the variable guide vane; or at least one of the guide vanes of the plurality of guide vanes in the compressor is a stationary guide vane in the compressor having the flow-injection opening located at its pressure side and at least one of the guide vanes of the plurality of guide vanes in the compressor is a variable guide vane in the compressor having the flow-injection opening located at its pressure side. Thus the present system is beneficially implemented at different stages and/or through different stages, namely stationary guide vane stages and/or VGV stages of the compressor.

BRIEF DESCRIPTION OF THE DRAWINGS

The above mentioned attributes and other features and advantages of the present technique and the manner of attaining them will become more apparent and the present technique itself will be better understood by reference to the following description of embodiments of the present technique taken in conjunction with the accompanying drawings, wherein.

DETAILED DESCRIPTION OF INVENTION

Figure 1:
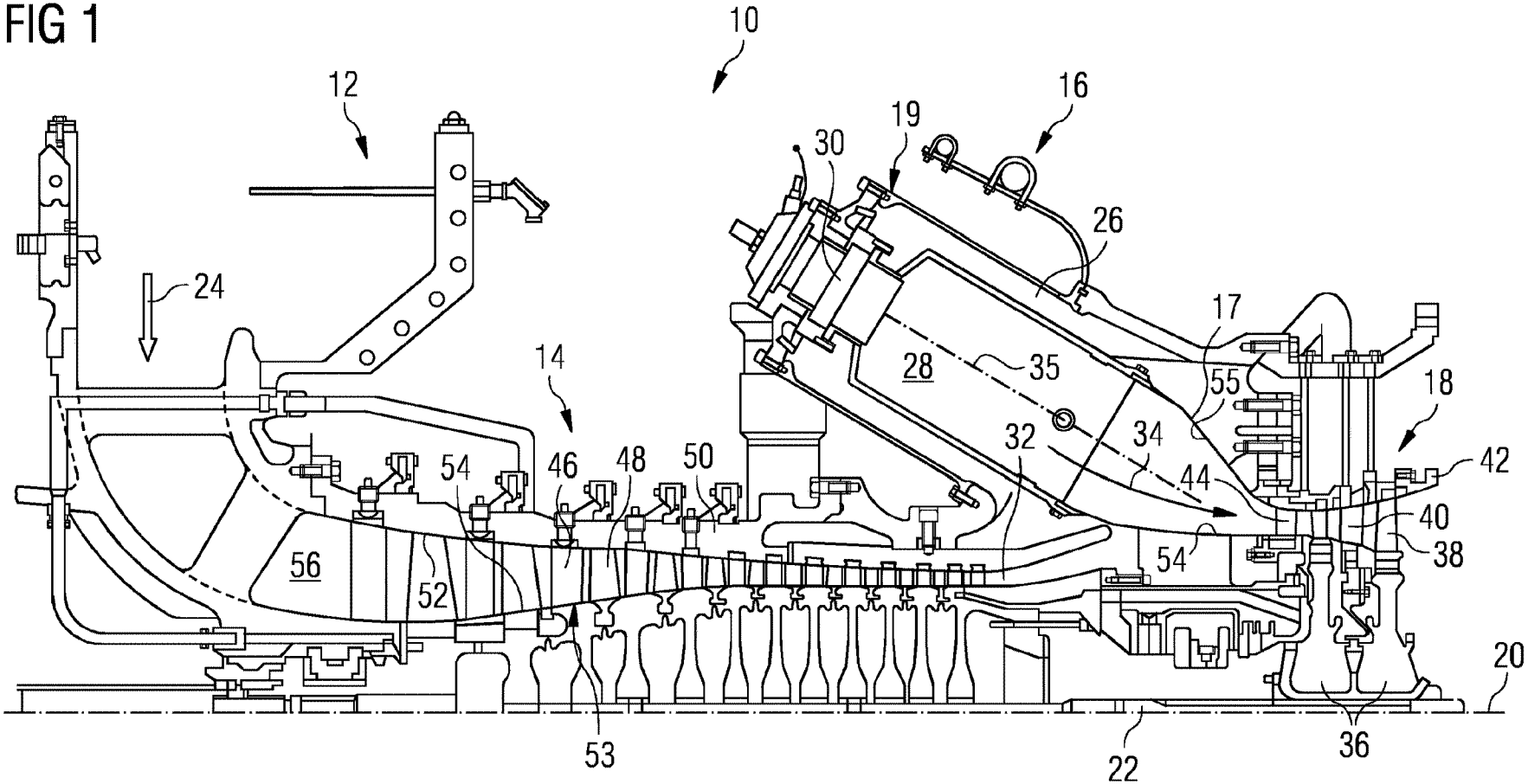
FIG. 1 shows part of a gas turbine engine in a sectional view and in which an exemplary embodiment of a method of the present technique is applied, and in which an exemplary embodiment of a system of the present technique is incorporated.

Hereinafter, above-mentioned and other features of the present technique are described in details. Various embodiments are described with reference to the drawing, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

FIG. 1 shows an example of a gas turbine engine 10 in a sectional view. The gas turbine engine 10 comprises, in flow series, an inlet 12, a compressor or compressor section 14, a combustor section 16 and a turbine section 18 which are generally arranged in flow series and generally about and in the direction of a rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor 14 and delivered to the combustion section or burner section 16. The burner section 16 comprises a burner plenum 26, one or more combustion chambers 28 extending along a longitudinal axis 35 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channeled through the combustion chamber 28 to the turbine section 18 via a transition duct 17.

This exemplary gas turbine engine 10 has a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets form an annulus for channeling the combustion gases to the turbine 18.

The turbine section 18 comprises a number of blade carrying discs 36 attached to the shaft 22. In the present example, two discs 36 each carry an annular array of turbine blades 38 are shown. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas 34 from the combustion chamber 28 enters the turbine section 18 and drives the turbine blades 38 which in turn rotate the shaft 22. The guiding vanes 40, 44 serve to optimise the angle of the combustion or working gas 34 on the turbine blades 38.

The turbine section 18 drives the compressor 14, i.e. particularly a compressor rotor. The compressor 14 comprises an axial series of vane stages 46, or guide vane stages 46, and rotor blade stages 48. The rotor blade stages 48 comprise a rotor disc supporting an annular array of blades. The compressor 14 also comprises a casing 50 that surrounds the rotor blade stages 48 and supports the guide vane stages 46. The guide vane stages 46 include an annular array of radially extending guide vanes 7 (not shown in FIG. 1) that are mounted to the casing 50. The guide vanes 7, hereinafter also referred to as the vanes 7, are provided to present gas flow at an optimal angle for the blades of the rotor blade stage 48 that is present adjacent to and downstream of, with respect to a flow direction of the air 24 along the compressor 14 at a given engine operational point. Some of the guide vane stages 46 have variable guide vanes 7 (not shown in FIG. 1), where the angle of the guide vanes 7, about their own longitudinal axis (not shown), can be adjusted for angle according to air flow characteristics that can occur at different engine operations conditions. Some of the other guide vane stages 46 have stationary guide vanes 7 (not shown in FIG. 1) where the angle of the guide vanes 7, about their own longitudinal axis, is fixed and thus not adjustable for angle. The guide vanes 7 i.e. the stationary and the variable guide vanes are well known in the art of compressors 14 and thus have not been described herein in details for sake of brevity.

The casing 50 defines a radially outer surface 52 of the passage 56 of the compressor 14. The guide vane stages 46 and the rotor blade stages 48 are arranged in the passage 56, generally alternately axially. The passage 56 defines a flow path for the air through the compressor 14 and is also referred to as an axial flow path 56 of the compressor 14. The air 24 coming from the inlet 12 flows over and around the guide vane stages 46 and the rotor blade stages 48. A radially inner surface 54 of the passage 56 is at least partly defined by a rotor drum 53 of the rotor which is partly defined by the annular array of blades.

The present technique is described with reference to the above exemplary turbine engine having a single shaft or spool connecting a single, multi-stage compressor and a single, one or more stage turbine. However, it should be appreciated that the present technique is equally applicable to two or three shaft engines and which can be used for industrial, aero or marine applications. Furthermore, the cannular combustor section arrangement 16 is also used for exemplary purposes and it should be appreciated that the present technique is equally applicable to gas turbine engines 10 having annular type and can type combustion chambers.

The terms axial, radial and circumferential are made with reference to the rotational axis 20 of the engine, unless otherwise stated.

Figure 2:
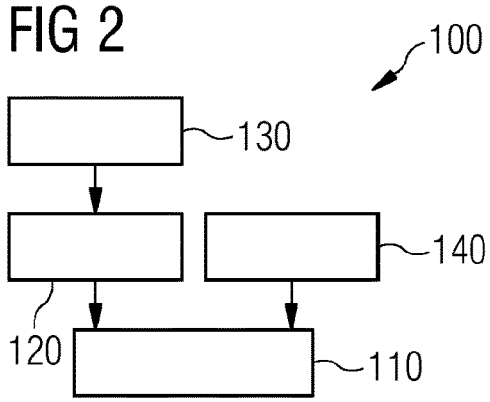
FIG. 2 illustrates an exemplary embodiment of the method of the present technique.
Figure 4:
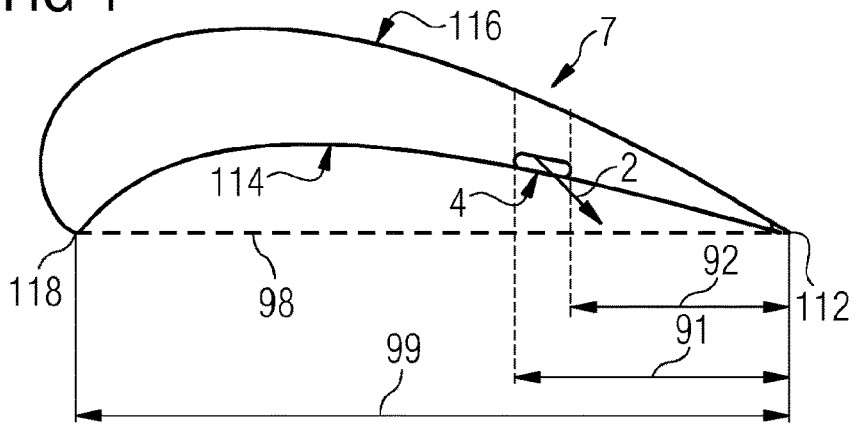
FIG. 4 schematically illustrates a cross-sectional view of guide vane of the guide vane stage of FIG. 3 depicting a flow-injection opening and a flow injection emanating from the flow-injection opening.
Figure 5:
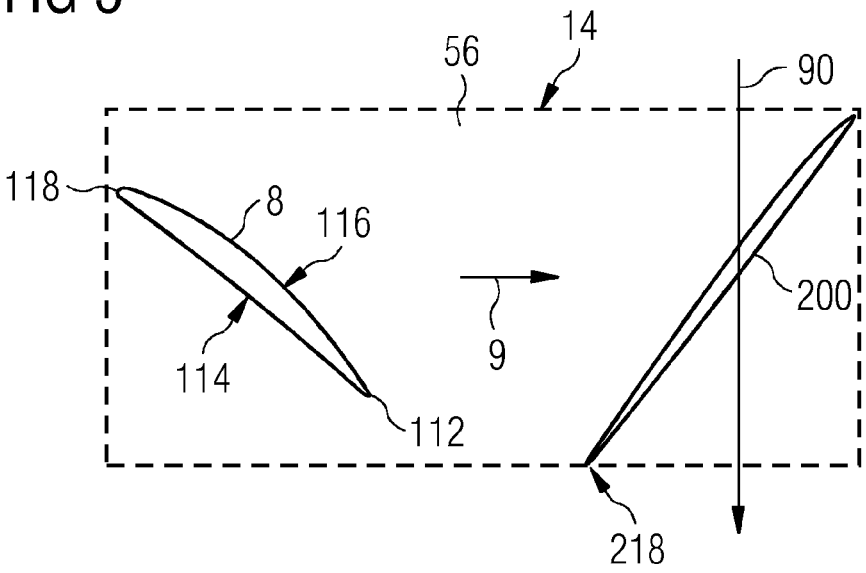
FIG. 5 schematically illustrates a conventionally known scheme of air flow in a part of the compressor without the flow-injection opening and the flow injection of FIG. 4.
Figure 7:
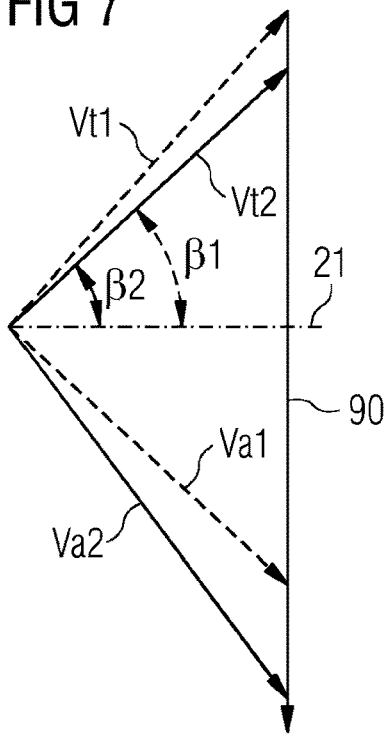
FIG. 7 schematically illustrates an exemplary effect on the air flow of FIG. 6.
Figure 8:
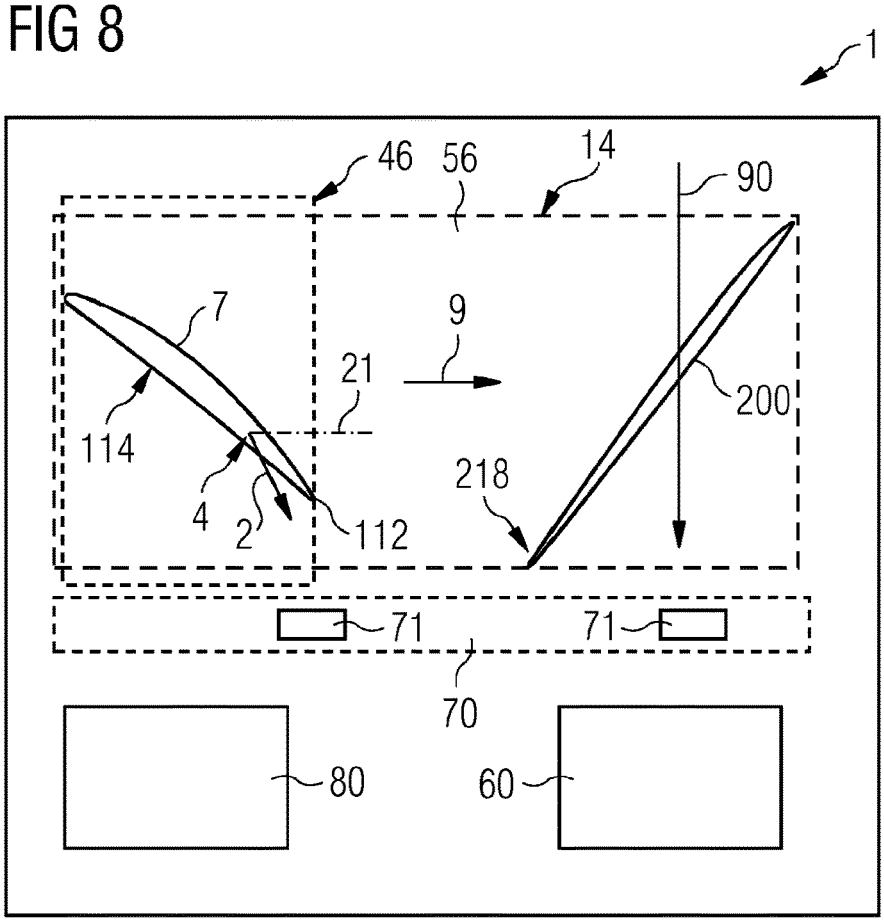
FIG. 8 schematically illustrates a system of the present technique; in accordance with aspects of the present technique.

FIG. 2 schematically illustrates a flow chart of an exemplary embodiment of a method 100 for controlling a rotating stall in the compressor 14 of the gas turbine engine 10. FIG. 8 schematically illustrates a system 1 for controlling a rotating stall in the compressor 14 of the gas turbine engine 10. The terms 'control', 'controlling', and like terms, as used herein in the present technique include mitigating and/or reducing the rotating stalls, obviating development of rotating stalls and/or reducing strength of rotating stalls in the compressor 14. Hereinafter the method 100 and the system 1 of the present technique have been described in details with reference to FIGS. 1 and 8, in combination with FIGS. 3, 4, 6, 7 and 8. FIG. 5 has been used to schematically illustrate a conventionally known scheme of air flow in a part of the compressor 14 where the present technique, i.e. the method 100 and/or the system 1, has not been implemented or incorporated.

Figure 3:
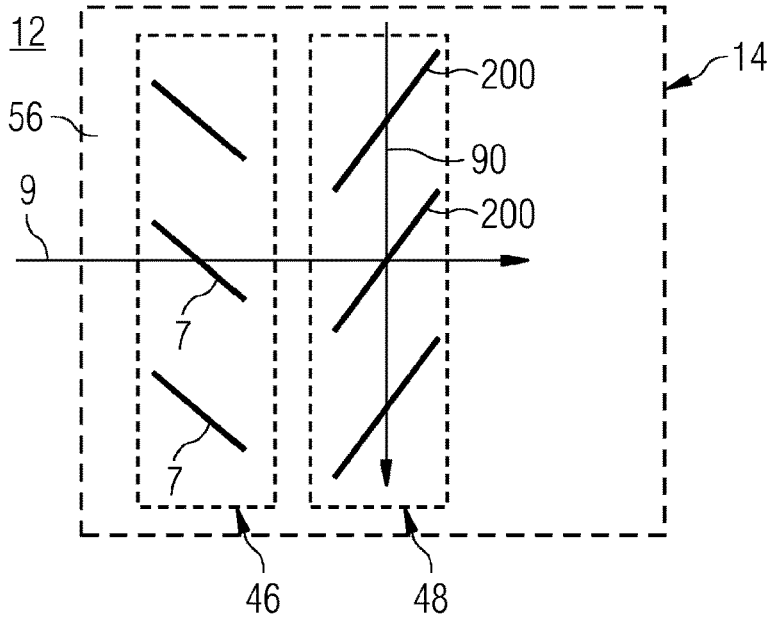
FIG. 3 schematically illustrates an exemplary arrangement of a guide vane stage and a rotor blade stage in a compressor of the gas turbine engine of FIG. 1.

As shown in FIG. 3, in the compressor 14 the guide vane stage 46 and the rotor blade stage 48 are present. The guide vane stage 46, hereinafter also referred to as the vane stages 46, may be variable guide vane stages 46 having a plurality of variable guide vanes (VGVs) 7, or may be stationary guide vane stages 46 having a plurality of stationary guide vanes (SGVs) 7. The VGV stages 46 are generally present in initial stages of the compressor 14 for example in first, second and third stages, whereas the SGV stages 46 are generally present in later stages of the compressor 14, for example in fourth to tenth stages of the compressor 14. The guide vanes 7, hereinafter also referred to as the vane 7 or vanes 7, are arranged in a row forming the vane stage 46. In FIG. 3 only one vane stage 46 of the compressor 14 and only one rotor blade stage 48, hereinafter also referred to as the blade stage 48, located immediately downstream with respect to an axial direction 9 of the air flow has been depicted, however in general the compressor 14 comprises a plurality of vane stages 46 and the blade stages 48. The blade stage 48 comprises of a row of compressor rotor blades 200, hereinafter also referred to as the blades 200. When the gas turbine engine 10 is operational, air 24 (shown in FIG. 1) enters through the inlet 12 and is guided by the first set of vane stage 46, i.e. by the vanes 7, towards the downstream located blades 200. The blades 200 rotate about the axis 20 (shown in FIG. 1) for compressing the air 24 as it passes through the axial air flow path 56 of the compressor 14. A direction of rotation of the blades 200 has been depicted in FIG. 3 with an arrow marked by reference numeral 90.

For better understanding of the method 100 of FIG. 2 and the system 1 of FIG. 8, the guide vane 7 of the method 100 and the system 1 has been explained hereinafter in reference to FIG. 4. According to aspects of the present technique, the guide vane stage 46 of the compressor 14 includes one or more guide vanes 7 that have a flow-injection opening 4 located at a pressure side 114 of the guide vane 7. The flow-injection opening 4, hereinafter also referred to as the opening 4, is configured to introduce a flow injection 2 into the axial air flow path 56 (shown in FIGS. 1 and 3) of the compressor 14. The opening 4 may be understood as a hole that is supplied by air from within the vane 7 and that injects air so supplied into the flow path 56. The opening 4 may have any shape, for example circular, rectangular, triangular, and so on and so forth. The air used for forming the flow injection 2, i.e. the air injected into the flow path 56 via the opening 4 may be channeled from a location downstream, with respect to the axial flow direction 9, of a location of the guide vane 7 from within the compressor 14. Alternatively, the air forming the flow injection 2 may be supplied from an outside source (not shown) for example a pressurized air tank. The air is generally sent from the casing 50 (shown in FIG. 1), i.e. from pathways or passages or channels (not shown) in the casing 50 through the body of the vane 7 and out into the flow path 56 via the opening 4 in form of one or more jets of air. Generally the air injected into the flow path 56 is at same or higher pressure than the pressure of the flow path 56 at the location of the guide vane 7 having the opening 4.

The vane 7 has a suction side 116, a leading edge 118 and a trailing edge 112. A chord of the vane 7 has been represented by a dotted line 98 and a chord length by the arrow marked by reference numeral 99. In one embodiment of the vane 7, the flow-injection opening 4 is located between 5 percent and 30 percent of the chord length 99 of the guide vane 7 measured from the trailing edge 112 of the guide vane 7 i.e. edges of the opening 4 are present within distances 91 and 92 and wherein the distance 91 is 30% of the distance 99 measured from the trailing edge 112 whereas the distance 92 is 5% of the distance 99 measured from the trailing edge 112. Furthermore, the opening 4 is located between a base (not shown) of the guide vane 7 and 50% of a span (not shown) of the guide vane 7 as measured from the base of the guide vane 7. The opening 4 may be present in form of smaller openings (not shown) for example as an array of small holes or openings that together function to produce one or more jets together forming the flow injection 2. The locations in an exemplary embodiment the opening 4 may be located such that the opening 4 is limited to at least farther than 5% of the chord length 99 from the trailing edge 112 and within 15% to 35% of the chord length 99 from the trailing edge 112. The opening 4 may be of dimensions such that it extends all through between 10% and 30% of the chord length 99 and between 5% and 50% of the span, on the pressure side 114.

Furthermore, the flow injection 2 is advantageously angular to a surface of the pressure side 114 and not perpendicular to the surface of the pressure side 114. The angular flow injection 2 may be achieved by physical dimensions of the opening 4 for example by forming the opening 4 slanted in within the body of the vane 7.

Figure 6:
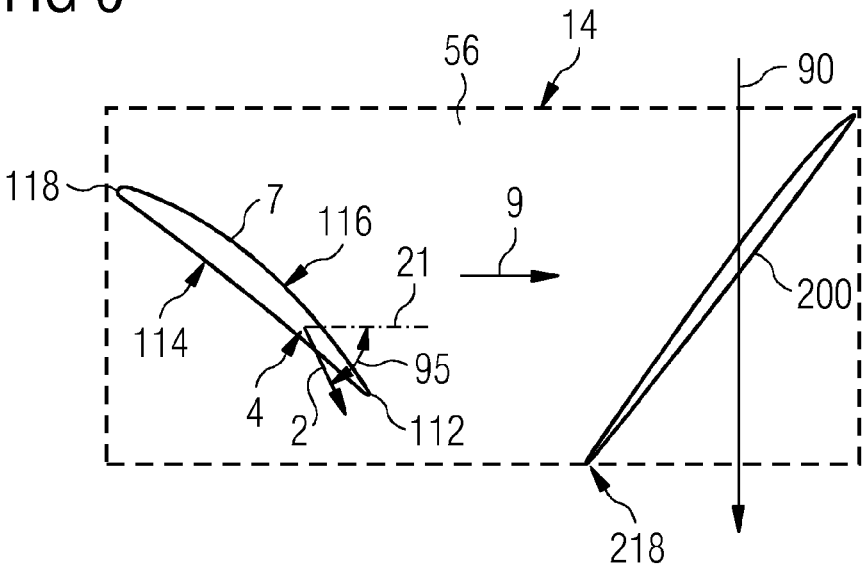
FIG. 6 schematically illustrates a scheme of air flow according to the present technique in a part of the compressor having the flow-injection opening and the flow injection of FIG. 4.

Hereinafter Referring to FIGS. 2 and 8, in combination with FIGS. 3 and 4, have been referred to for explaining an exemplary embodiment of the method 100 and an exemplary embodiment the system 1 of the present technique, respectively. FIGS. 6 and 7 have been referred, to depict an exemplary working of the present technique. FIG. 5, that illustrates a conventionally known scheme of air flow in a part of the compressor 14 having a conventionally known vane 8 i.e. a compressor vane that does not have the opening 4 and the flow injection 2 of the vane 7 of FIG. 4, has been used to draw a contrast with the scheme of air flow shown in FIG. 6 of the present technique.

As shown in FIG. 2, in the method 100, in a step 110 the flow injection 2 is introduced in the compressor 14. The flow injection 2 is introduced in step 110 into the axial air flow path 56, by injecting the air from within the vane 7 into the axial air flow path 56, of the compressor 14 via the flow-injection opening 4. As shown in FIG. 6, the flow injection 2 is directed towards a leading edge 218 of a compressor rotor blade 200 of the blade stage 48 located downstream of the guide vane 7 with respect to the axial flow direction 9. The compressor rotor blade 200, hereinafter also referred to as the blade 200, is located immediately or adjacently downstream i.e. physically distanced but next to or close to, of the vane 7, as shown in FIG. 3, and forms one or more blades of the blade stage 48, or the blade assembly 48, of FIG. 3. The blade 200 has the leading edge 218 aligned close to the vane 7.

FIG. 7 schematically shows effect, on the blade 200, of the flow injection 2 of FIG. 6 in comparison to the effect, on the blade 200, of absence of flow injection 2 of FIG. 5. In FIG. 7 the dotted line parts show the effect on the blade 200, particularly on the leading edge 218 of the blade 200, of air flow without the flow injection 2 of the present technique whereas the solid line parts of FIG. 7 show the effect on the blade 200, particularly on the leading edge 218 of the blade 200, of air flow with the flow injection 2 of the present technique. As shown in FIG. 6, in the present technique, the flow injection 2 is introduced 110, by injecting the air from within the vane 7 into the axial air flow path 56 of the compressor 14 at an angle 95 between 30 degree and 60 degree with respect to an axis 21 parallel to a rotational axis of the compressor 14 which in turn is same as the axis 20 of FIG. 1.

In FIG. 7, an arrow 'Va1' shows a vector representing the air flow from the vane 8 towards the leading edge 218 when the flow injection 2 is absent, as shown in FIG. 5, and an arrow 'Va2' shows a vector representing the air flow from the vane 7 towards the leading edge 218 when the flow injection 2 is present, as shown in FIG. 6, with respect to the axis 21. In FIG. 7, an arrow 'Vt1' shows a vector representing the air flow as received by the leading edge 218 corresponding to the vector Va1 and an arrow 'Vt2' shows a vector representing the air flow as received by the leading edge 218 corresponding to the vector Va1, with respect to the axis 21, The vectors represent velocity of the air flow.

As can be seen from FIG. 7, an angle β2, i.e. the flow angle, formed by the vector Vt2 with the axis 21 i.e. when the flow injection 2 is present, is smaller than an angle β1, i.e. the flow angle, formed by the vector Vt1 with the axis 21 i.e. when the flow injection 2 is absent. Thus, when the compressor 14 is in operation, particularly at off design conditions i.e. when the compressor 14 is operating at a speed lower than full load speed for the compressor 14 or the design speed of the compressor 14 which is the speed for which the compressor 14 has been designed to operate normally or when a rotating stall has developed in the compressor 14, due to the flow injection 2 via the opening 4 of the vane 7, the flow angle β2 into the blade stage 48, particularly into the blade 200, is reduced or smaller as compared to the flow angle β1 into the blade stage 48, particularly into the blade 200, when the flow injection 2 is not present, and hence the blade 200 in presence of the vane 7 having the opening 4 from which the flow injection 2 emanates sees or is subjected to a more favourable velocity Vt2. The velocity Vt2 is more favourable compared to the velocity Vt1 because the air flow with flow angle β2 is aerodynamically more aligned as compared to the air flow with flow angle β1. The favourable velocity Vt2 increases the operating range of the blade stage 48, which in turn increases the operating range of the compressor 14 by controlling the rotor stall in the compressor 14.

Thus, in the method 100, the flow injection 2 is introduced either when the compressor 14 is being operated at a speed lower than full load speed for the compressor 14 or the design speed of the compressor 14, as mentioned above; or when a rotating stall is detected in the compressor 14 as a condition for introducing flow injection 2 in the compressor 14 during operation of the gas turbine engine 10. Therefore, in an exemplary embodiment, the method 100 includes a step 120, performed before the step 110, of determining the condition for introducing flow injection 2 in the compressor 14 during operation of the gas turbine engine 10. The condition for introducing flow injection 2 in the compressor 14 during operation of the gas turbine engine 10 is detection of the rotating stall in the compressor 14. In a related embodiment, the method 100 includes a step 130, performed before the step 120, of detecting the rotating stall in the compressor 14. Furthermore, as aforementioned, the air injected into the flow path 56 via the opening 4 may be channeled from a location downstream, with respect to the axial flow direction 9, of a location of the guide vane 7 from within the compressor 14, and in an embodiment of the method 100, the method 100 includes a step 140, performed before the step 110, of channeling air of the compressor 14 from a location downstream of a location of the guide vane 7, with respect to the axial flow direction 9.

As shown in FIG. 8, the system 1 includes the guide vane 7 and a controller 60. The guide vane 7 is same as the vane 7 explained in reference to FIG. 2. The controller 60 determines a condition for introducing flow injection 2 in the compressor 14 during operation of the gas turbine engine 10. The condition may be, but not limited to, a state of the compressor 14 when the compressor 14 is being operated at a speed lower than full load speed for the compressor 14 or the design speed of the compressor 14, and/or when a rotating stall is detected in the compressor 14. The controller 60 initiates the introduction of the flow injection 2 when the condition for introducing flow injection 2 in the compressor 14 is determined. The controller 60 may be a processor, e.g. a microprocessor, a programmable logic controller (PLC), and so on and so forth. Additionally, the system 1 may include a sensing arrangement 70 for detecting parameters, such as pressure at different axial locations in the compressor 14, indicative of a rotating stall in the compressor 14. The sensing arrangement or mechanism 70 may include one or more sensors 71, for example pressure sensors 71 located in association with the compressor 14 to determine pressures at different axial locations in the compressor 14. The controller 60 receives the parameters so detected, and based on the parameters so detected may initiate the introduction of the flow injections 2 at one or multiple axial locations within the compressor 14. Furthermore, the system 1 may include a flow controlling mechanism 80 that regulates the flow injection 2, i.e. starts the flow injection 2, and/or stops the flow injection 2, and/or decreases and/or increases strength of the flow injection 2 i.e. rate of flow of air forming the flow injection 2. The controller 60 controls or directs the flow controlling mechanism 80 to regulate the flow injection 2. The flow controlling mechanism 80 may include control valves, actuators, etc. In general, arrangements, such as the sensing arrangement 70, that detect parameters indicative of a rotating stall in the compressor 14, and mechanisms, such as the flow controlling mechanism 80, that regulate a flow of a fluid through an opening or a hole, are well known in the art of gas turbine performance monitoring and in the art of fluid mechanics, respectively, and thus not been explained further herein in details for sake of brevity.

While the present technique has been described in detail with reference to certain embodiments, it should be appreciated that the present technique is not limited to those precise embodiments. It may be noted that, the use of the terms 'first', 'second', etc. does not denote any order of importance, but rather the terms 'first', 'second', etc. are used to distinguish one element from another. Rather, in view of the present disclosure which describes exemplary modes for practicing the invention, many modifications and variations would present themselves, to those skilled in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

The invention claimed is:

1. A system for controlling a rotating stall in a compressor for a gas turbine engine, the system comprising:

a guide vane stage of the compressor, wherein the guide vane stage includes a plurality of guide vanes and wherein at least one of the guide vanes include a flow-injection opening located at a pressure side of the guide vane, the flow-injection opening adapted to introduce a flow injection into an axial air flow path of the compressor and directed towards a leading edge of a compressor rotor blade located adjacently downstream of the guide vane having the flow-injection opening;

pressure sensors arranged to detect parameters indicative of rotating stall in the compressor; and a controller coupled to receive from the pressure sensors the parameters indicative of rotating stall in the compressor, the controller adapted to determine a condition for introducing flow injection in the compressor during operation of the gas turbine engine, the controller further adapted to initiate introduction of the flow injection when the condition for introducing flow injection in the compressor is determined based on the parameters received from the pressure sensors being indicative of the rotating stall in the compressor, wherein the flow injection is introduced in the compressor when the controller determines the compressor is being operated at a speed that is in a range from 40% to 75% of the full load speed of the compressor or the design speed of the compressor.

2. The system according to claim 1, further comprising:

valves and actuators adapted to regulate the flow injection emanating from the flow-injection opening of the guide vane, and wherein the controller is further adapted to control the valves and actuators to regulate the flow injection.

3. The system according to claim 1, wherein the flow-injection opening is located between 5 percent and 30 percent of a chord length of the guide vane measured from a trailing edge of the guide vane.

4. The system according to claim 1, wherein the flow-injection opening is located in a range from 5% to 95% of the radial span of the guide vane measured from the base of the guide vane or the flow-injection opening is located between a base of the guide vane and 50 percent of a span of the guide vane measured from the base of the guide vane.

5. The system according to claim 1, wherein the flow-injection opening is adapted to introduce the flow injection into the axial air flow path of the compressor at an angle between 30 degree and 60 degree with respect to an axis parallel to a rotational axis of the compressor.

6. The system according to claim 1, wherein at least one of the guide vanes of the plurality of guide vanes in the compressor is a stationary guide vane in the compressor and wherein the flow-injection opening is located at a pressure side of the stationary guide vane; and/or wherein at least one of the guide vanes of the plurality of guide vanes in the compressor is a variable guide vane in the compressor and wherein the flow-injection opening is located at a pressure side of the variable guide vane.

7. The system according to claim 1, wherein the flow injection is introduced in the compressor when the compressor is being operated at a speed that is in a range from 50% to 70%, of the full load speed of the compressor or the design speed of the compressor.

8. A method for controlling a rotating stall in a compressor for a gas turbine engine, the method comprising:

introducing a flow injection in the compressor, wherein the flow injection is introduced into an axial air flow path of the compressor via a flow-injection opening located at a pressure side of at least one guide vane of a plurality of guide vanes forming a guide vane stage in the compressor, and wherein the flow injection is directed towards a leading edge of a compressor rotor blade located adjacently downstream of the guide vane having the flow-injection opening;

determining a condition for introducing flow injection in the compressor during operation of the gas turbine engine, wherein the flow injection in the compressor is introduced when the condition for introducing flow injection in the compressor is determined, and wherein the condition for introducing flow injection in the compressor during operation of the gas turbine engine is detection of the rotating stall in the compressor; and detecting the rotating stall in the compressor wherein the flow injection is introduced in the compressor when the compressor is being operated at a speed lower than full load speed for the compressor, wherein the flow injection is introduced in the compressor when the compressor is being operated at a speed that is in a range from 40% to 75% of the full load speed of the compressor or the design speed of the compressor.

9. The method according to claim 8, wherein the flow-injection opening is located between 5 percent and 30 percent of a chord length of the guide vane measured from a trailing edge of the guide vane.

10. The method according to claim 8, wherein the flow-injection opening is located between a base of the guide vane and 50 percent of a span of the guide vane measured from the base of the guide vane.

11. The method according to claim 8, wherein in introducing the flow injection in the compressor, the flow injection is introduced into an axial air flow path of the compressor at an angle between 30 degree and 60 degree with respect to an axis parallel to a rotational axis of the compressor.

12. The method according to claim 8, further comprising:

channeling air of the compressor from a location downstream of a location of the guide vane having the flow-injection opening with respect to an axial flow direction of air in the compressor.

13. The method according to claim 8, wherein at least one of the guide vanes of the plurality of guide vanes in the compressor is a stationary guide vane in the compressor and wherein the flow-injection opening is located at a pressure side of the stationary guide vane; and/or wherein at least one of the guide vanes of the plurality of guide vanes in the compressor is a variable guide vane in the compressor and wherein the flow-injection opening is located at a pressure side of the variable guide vane.

14. The method according to claim 8, wherein flow injection is implemented when at least one of a pre-determined compressor speed, a vibration characteristic and a pressure threshold value or range of values is attained.

15. The method according to claim 8, wherein the flow injection is introduced in the compressor when the compressor is being operated at a speed that is in a range from 50% to 70%, of the full load speed of the compressor or the design speed of the compressor.

16. The method according to claim 8, wherein detecting rotating stall is made via any one or more of pressure sensors mounted within the compressor and monitoring compressor vibrations via an optical or digital probe in view of the blades of the compressor.

* * * * *